US009949054B2

(12) United States Patent
Kadri et al.

(10) Patent No.: US 9,949,054 B2
(45) Date of Patent: Apr. 17, 2018

(54) SPATIAL MAPPING OF AUDIO PLAYBACK DEVICES IN A LISTENING ENVIRONMENT

(71) Applicant: Sonos, Inc., Santa Barbara, CA (US)

(72) Inventors: Romi Kadri, Cambridge, MA (US); Chris Davies, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 14/871,494

(22) Filed: Sep. 30, 2015

(65) Prior Publication Data

US 2017/0094437 A1 Mar. 30, 2017

(51) Int. Cl.

| | |
|---|---|
| ***H04R 5/00*** | (2006.01) |
| ***H04S 7/00*** | (2006.01) |
| ***H04R 5/02*** | (2006.01) |
| ***H04R 27/00*** | (2006.01) |
| ***H04R 3/12*** | (2006.01) |
| *H04R 29/00* | (2006.01) |

(52) U.S. Cl.

CPC ..... *H04S 7/301* (2013.01); *H04R 3/12* (2013.01); *H04R 5/02* (2013.01); *H04R 27/00* (2013.01); *H04S 7/307* (2013.01); *H04R 2203/12* (2013.01); *H04R 2227/005* (2013.01); *H04R 2420/07* (2013.01); *H04R 2430/01* (2013.01)

(58) Field of Classification Search

CPC ..... H04S 7/301; H04S 7/307; H04R 5/02; H04R 27/00; H04R 2203/12; H04R 2227/005; H04R 2420/07; H04R 3/12; H04R 2430/01

USPC ..... 381/304, 311

See application file for complete search history.

(56) References Cited

U.S. PATENT DOCUMENTS

| | | | |
|---|---|---|---|
| 5,440,644 | A | 8/1995 | Farinelli et al. |
| 5,761,320 | A | 6/1998 | Farinelli et al. |
| 5,923,902 | A | 7/1999 | Inagaki |
| 6,032,202 | A | 2/2000 | Lea et al. |
| 6,256,554 | B1 | 7/2001 | DiLorenzo |
| 6,404,811 | B1 | 6/2002 | Cvetko et al. |
| 6,469,633 | B1 | 10/2002 | Wachter |
| 6,522,886 | B1 | 2/2003 | Youngs et al. |
| 6,611,537 | B1 | 8/2003 | Edens et al. |
| 6,631,410 | B1 | 10/2003 | Kowalski et al. |
| 6,757,517 | B2 | 6/2004 | Chang |
| 6,778,869 | B2 | 8/2004 | Champion |

(Continued)

FOREIGN PATENT DOCUMENTS

| | | |
|---|---|---|
| EP | 1389853 A1 | 2/2004 |
| WO | 0153994 A2 | 7/2001 |

(Continued)

OTHER PUBLICATIONS

"AudioTron Quick Start Guide, Version 1.0", Voyetra Turtle Beach, Inc., Mar. 2001, 24 pages.

(Continued)

*Primary Examiner* — Vivian Chin
*Assistant Examiner* — Ammar Hamid

(57) ABSTRACT

Method and apparatus for spatial mapping of two or more audio playback devices in a listening environment. Two or more playback devices may signal each other. Based on the signaling, a position of the two or more playback devices relative to each other is determined and a device map of the two or more playback devices in the listening environment is generated based on this position.

12 Claims, 13 Drawing Sheets

(56) References Cited

U.S. PATENT DOCUMENTS

| | | | | |
|---|---|---|---|---|
| 7,130,608 | B2 | 10/2006 | Hollstrom | |
| 7,130,616 | B2 | 10/2006 | Janik | |
| 7,143,939 | B2 | 12/2006 | Henzerling | |
| 7,236,773 | B2 | 6/2007 | Thomas | |
| 7,295,548 | B2 | 11/2007 | Blank et al. | |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,987,294 | B2 | 7/2011 | Bryce et al. | |
| 8,014,423 | B2 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,483,853 | B1 | 7/2013 | Lambourne | |
| 8,995,240 | B1 * | 3/2015 | Erven | H04B 1/20 369/2 |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0061001 | A1 * | 3/2003 | Willins | G01S 5/0284 702/153 |
| 2003/0157951 | A1 | 8/2003 | Hasty | |
| 2004/0024478 | A1 | 2/2004 | Hans et al. | |
| 2007/0142944 | A1 | 6/2007 | Goldberg et al. | |
| 2009/0003613 | A1 * | 1/2009 | Christensen | H04S 7/301 381/58 |
| 2009/0081948 | A1 | 3/2009 | Banks et al. | |
| 2009/0110204 | A1 * | 4/2009 | Walsh | G10L 19/16 381/17 |
| 2012/0124602 | A1 * | 5/2012 | Tan | G09B 5/06 725/9 |
| 2015/0215723 | A1 * | 7/2015 | Carlsson | H04S 7/307 381/307 |
| 2015/0220302 | A1 * | 8/2015 | Kallai | H04R 3/12 700/94 |
| 2015/0256954 | A1 * | 9/2015 | Carlsson | H04R 27/00 381/59 |

FOREIGN PATENT DOCUMENTS

| | | | | |
|---|---|---|---|---|
| WO | 2003093950 | A2 | 11/2003 | |
| WO | 2007068257 | A1 | 6/2007 | |
| WO | WO 2007068257 | A1 * | 6/2007 | H04S 7/301 |

OTHER PUBLICATIONS

"AudioTron Reference Manual, Version 3.0", Voyetra Turtle Beach, Inc., May 2002, 70 pages.
"AudioTron Setup Guide, Version 3.0", Voyetra Turtle Beach, Inc., May 2002, 38 pages.
"Bluetooth. "Specification of the Bluetooth System: The ad hoc Scatternet for affordable and highly functional wireless connectivity" Core, Version 1.0 A, Jul. 26, 1999, 1068 pages".
"Bluetooth. "Specification of the Bluetooth System: Wireless connections made easy" Core, Version 1.0 B, Dec. 1, 1999, 1076 pages".
"Dell, Inc. "Dell Digital Audio Receiver: Reference Guide" Jun. 2000, 70 pages".
"Dell, Inc. "Start Here" Jun. 2000, 2 pages".
"Jo, J. et al., "Synchronized One-to-many Media Streaming with Adaptive Playout Control," Proceedings of SPIE, 2002, pp. 71-82, vol. 4861".
Jones, Stephen, "Dell Digital Audio Receiver: Digital upgrade for your analog stereo" Analog Stereo Jun. 24, 2000 retrieved Jun. 18, 2014, 2 pages.
Louderback, Jim, "Affordable Audio Receiver Furnishes Homes With MP3" TechTV Vault. Jun. 28, 2000 retrieved Jul. 10, 2014, 2 pages.
Palm, Inc., "Handbook for the Palm VII Handheld," May 2000, 311 pages.
Presentations at WinHEC 2000, May 2000, 138 pages.
"UPnP; "Universal Plug and Play Device Architecture"; Jun. 8, 2000; version 1.0; Microsoft Corporation; pp. 1-54".
International Searching Authority, International Search Report and Written Opinion dated Dec. 13, 2016, issued in connection with International Application No. PCT/US2016/050752, filed on Sep. 8, 2016, 9 pages.
"Denon 2003-2004 Product Catalog," Denon, 2003-2004, 44 pages.
U.S. Appl. No. 60/490,768, filed Jul. 28, 2003, entitled "Method for synchronizing audio playback between multiple networked devices," 13 pages.
U.S. Appl. No. 60/825,407, filed Sep. 12, 2006, entitled "Controlling and manipulating groupings in a multi-zone music or media system," 82 pages.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

SPATIAL MAPPING OF AUDIO PLAYBACK DEVICES IN A LISTENING ENVIRONMENT

FIELD OF THE DISCLOSURE

The disclosure is related to consumer goods and, more particularly, to methods, systems, products, features, services, and other elements directed to media playback or some aspect thereof.

BACKGROUND

Options for accessing and listening to digital audio in an out-loud setting were limited until in 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
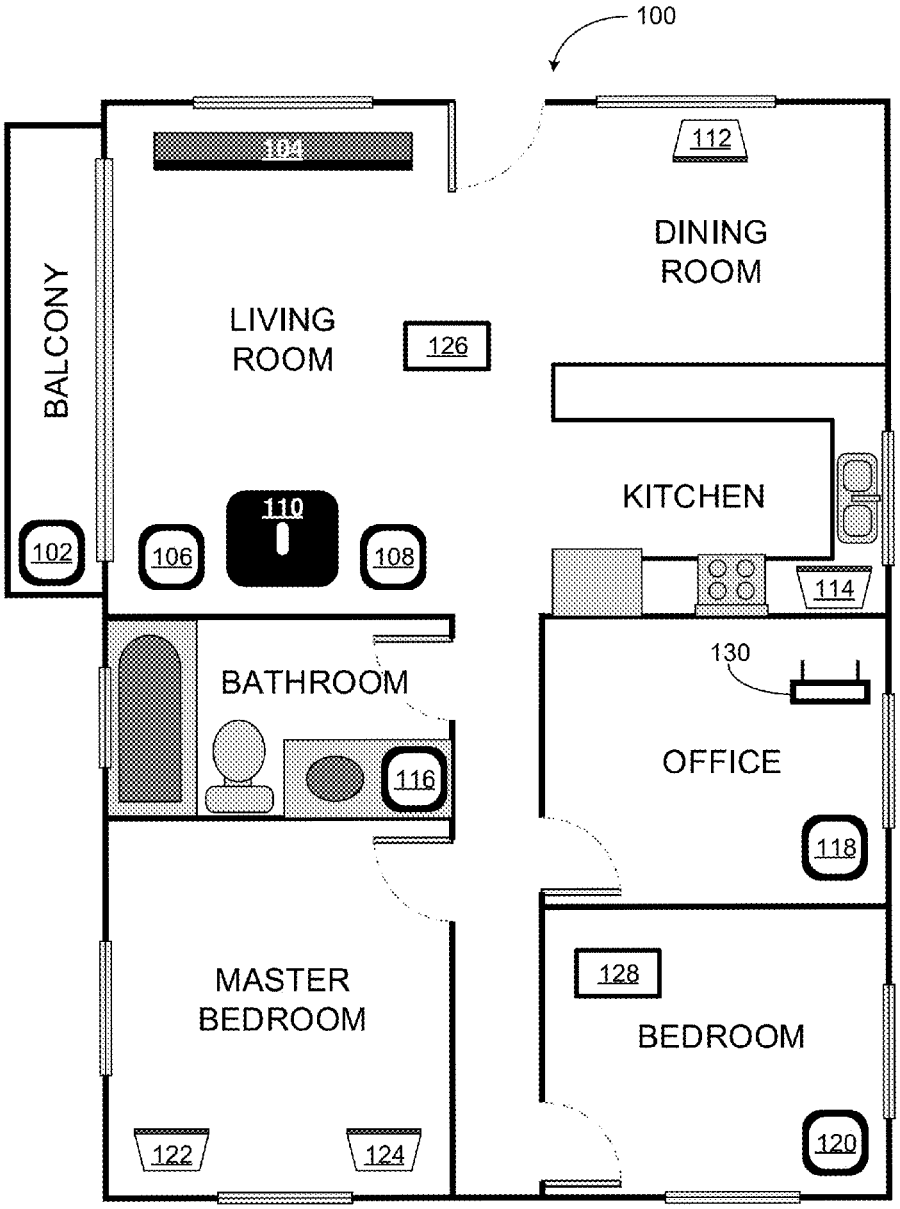
FIG. 1 shows an example playback system configuration in which certain embodiments may be practiced.

The drawings are for the purpose of illustrating example embodiments, but it is understood that the inventions are not limited to the arrangements and instrumentality shown in the drawings.

DETAILED DESCRIPTION

I. Overview

An example playback device plays audio sound. An example listening environment may be a home theatre, living room, bedroom, or even the outdoor space of a home. Certain embodiments disclosed herein enable a spatial mapping of the audio playback devices in the listening environment.

Position of the playback devices in the listening environment is critical to providing the best audio experience. Placing a playback device too close or too far from a listener or orienting the direction of the playback device sub-optimally may impact quality of the audio sound heard by a listener. As an example, the audio may be distorted, undesirably attenuated, or undesirably amplified. By knowing the position of the playback devices, the audio playback device can adjust the audio sound to optimize the audio experience. For example, acoustic characteristics such as equalization, gain, and attenuation, of one or more playback devices can be adjusted or calibrated based on the playback device positioning through audio processing algorithms, filters, disabling playback devices, enabling playback devices, and the sort. Additionally or alternatively, knowing the position of the playback devices, a listener can readjust the position of the playback devices to optimize the audio experience.

A spatial mapping is a determination of the position of the playback devices. An example device map is an indication of distance and angle, for example, of each playback device relative to each other in the listening environment. In some instances, the distance and angle may be indicated by a distance such as meters, centimeters, feet, or inches and angle may be indicated by an angle such as degrees or radians.

The manual determination of a spatial mapping of playback devices has several disadvantage and is prone to error. The user needs to measure the position each playback device within precise angles and distances relative to each other. As such, the playback devices can be equipped with hardware and/software to facilitate the determination of its position. For example, the playback device may have WiFi or Bluetooth capability allowing the playback device to send and receive WiFi and Bluetooth signals, and measure a signal characteristic of the received signals in the form of a signal strength. Additionally or alternatively, the playback device may be equipped with a speaker to play audio sound and a microphone to pick up audio signals, such as audio sounds, played by other playback devices. In this arrangement, the playback device may measure a signal characteristic in the form of an acoustic measure such as delay, loudness, sound pressure limitation, and/or sound intensity.

The signal characteristic, as provided by the WiFi, Bluetooth, or acoustic measures, may then be used along with triangulation to determine the distance and/or angle of the playback devices relative to each other. Triangulation is a geometrical calculation that involves forming a triangle between two playback devices and a known reference point or between three playback devices. Based on knowing the length of two sides of this triangle and an angle, the length of all sides of the triangle, all angles of the triangle, or two angles and a length, the length of all sides of the triangle and all angles of the triangle can be determined. The length and angles translate into knowing the relative distance between the playback devices and the angles between the playback devices. The triangulation process produces the spatial mapping and repeating this process for all the playback devices enables creating a device map of the relative spatial position of each playback device in the listening area.

The audio sound played by the audio playback system may include several channels of audio. Each channel of audio may be designed to be played by a particular playback device in the audio playback system. For example, in a two dimensional audio system, a channel of audio may be one of the left front channel, right front channel, center channel, rear left channel, rear right channel or subwoofer. In a three dimensional audio system, there may be also channels above and channels below. The device map may then be further oriented by mapping at least one of the playback devices to a channel of the audio sound. Further, the device map may be oriented according to the distance and angle between a listening location and a "front" of the audio playback system. The listening location may be where the listener is situated in the listening environment and the front may be a virtual point between the forward-most audio playback devices in the listening area. The front and listening locations may be determined via manual input or automatically through triangulation using a WiFi or Bluetooth capable portable device or microphone/speaker enabled portable device, for example.

The angular orientation of each playback device can also be determined. The angular orientation may include the vertical or horizontal orientation of each playback device and/or the angular orientation of the playback device. In some examples, an accelerometer or gyroscope can indicate the vertical orientation of the playback device and triangulation can be used to determine the horizontal angular orientation. Further methods such as beam-steering can also be used to determine the angular horizontal orientation of the playback device.

An example of an illustration of the use of this method and apparatus is in a home theatre. An example home theatre may have several playback devices positioned above, below, and around a television screen. The playback devices collectively provide a listener in the home theatre with a surround sound audio experience. The playback devices, however, might not be properly positioned to provide the best audio experience. Positioning requires close attention during the set up of the playback devices in the home theatre. A small error in relative distance or angle between playback devices can significantly impair the audio experience.

The home theatre may have a control device such as an iPad or iPhone. The control device facilitates configuration of the playback devices in the home theatre. In this regard, the control device can cause each playback device, one at a time, to signal each of other playback devices to determine its position. From this signaling, a spatial mapping of the playback devices can be determined, for example, through a triangulation process to generate a device map for the listening area. To orient the device map correctly, a playback device in the home theatre is assigned a specific channel of audio output. For example, Dolby 5.1 has six audio channels, left front speaker, right front speaker, left rear speaker, right rear speaker, center speaker, and subwoofer. A left front speaker is identified in the device map to orient the device map in view of axes of symmetry.

Further, the device map can be oriented with respect to the listening location and the front of the home theatre. The front of the home theatre may be a virtual point between the front left playback device and front right playback device on either side of the television screen. The "listening location" may be a couch where the listener sits when listener sits when listening to the audio. Ideally, the listener sits directly in front of the "front", but in some instances this may not be the case, for example, when the playback devices are not equidistant from the listener. This results in a need to orient the device map with respect to these positions.

The location of the "front" and "listening location" may be input into the control device through a graphical user interface. Alternatively, a device such the iPhone or iPad can be physically placed at the "front" and "listening location" and a triangulation process can be employed to determine these locations.

The angular orientation of each playback device can also be noted in the device map. For instance, a playback device may be configured to be set on a surface horizontally or vertically. An accelerometer, for instance, can be used to determine the angular orientation of the playback device in the vertical direction. Further, the playback device may be angularly oriented in the horizontal direction. For instance, the playback device may not be facing in a way that is optimal for the audio experience. Again, through triangulation or beam-steering techniques, the horizontal angular orientation of the playback devices can be determined and the device map can reflect the proper distance, angle, and angular orientation of the playback devices in the listening environment.

Moving on from the above illustration, an example embodiment includes an example device comprising a sensor; a processor; a non-transitory computer readable medium, and program instructions stored on the non-transitory computer readable medium that, when executed by the processor, cause the device to perform functions comprising: sending a first signal indicative of a position of the device; receiving, by the sensor, a second signal indicative of a position of one or more playback devices; and determining the position of the device relative to the one or more playback device based on the second signal. The example device further comprises program instructions for generating a device map indicative of the position in a listening environment of the one or more playback devices and the device relative to each other based on the first signal and the second signal. The example program instructions for generating the device map comprises orienting the device map by assigning a given playback device of the one or more playback devices to a particular audio channel. The example program instructions for generating the device map comprises orienting the device map based on a location of a listener in the listening environment and a front of the listening environment. The first signal and the second signal of the example device may be an audio signal, a Bluetooth signal, or a WiFi signal. The example program instructions for determining the position of the device relative to the one or more playback device comprises performing a triangulation to determine a distance and angle between the device and the one or more playback devices wherein a side of a triangle is a signal characteristic of the second signal, the signal characteristic being proportional to a distance between the device and the one or more playback devices. The example program instructions further comprises determining an angular orientation of the device based on a difference in time delay of receipt of the second signal by two or more microphones of the device. The example program instructions for determining the angular orientation comprises determining a timing of receipt of a peak of a beam-formed signal by a microphone of the device. The example program instructions for determining the angular orientation comprises determining a horizontal angular orientation of the device and a vertical angular orientation of the device.

Certain embodiments comprise a method including sending by a given playback device, a first signal indicative of a position of the given playback device; receiving, by the given playback device, a second signal indicative of a position of the one or more playback devices; and determining the position of the given playback device relative to the one or more playback devices based on the second signal. The method of determining the position comprises performing a triangulation process to determine a distance and angle between the given playback device and the one or more playback devices wherein a side of a triangle is a signal characteristic of the second signal, the signal characteristic being proportional to a distance between the given playback device and the one or more playback devices. The method further comprises generating a device map indicative of the position in a listening environment of the one or more playback devices and the given playback device relative to each other based on the first signal and the second signal. The method of determining the position of the one or more playback device relative to the given playback device comprises performing a triangulation based on the second signal to determine a distance and angle between the given playback device and the one or more playback devices. The method further comprises determining an angular orientation of the given playback device based on a difference in time delay of receipt of the second signal by two or more microphones of the given playback device. The angular orientation of the method is determined based on a timing of receipt of a peak of a beam-formed signal by a microphone of the given playback device. The method of determining the angular orientation comprises determining a horizontal angular orientation of the device and a vertical angular orientation of the given playback device.

Certain embodiments comprise a tangible non-transitory computer readable storage medium including a set of instructions that when executed by a processor cause a media playback device to: send by the media playback device, a first signal indicative of position of the media playback device; receive, by the media playback device, a second signal indicative of position of the one or more playback devices; and determine the position of the media playback device relative to the one or more playback devices based on the second signal. The instructions for determining the position of the media playback device comprises determining an angular orientation of the media playback device. The instructions for determining the position comprises performing a triangulation process to determine a distance and angle between the media playback device and each of the one or more playback devices wherein a side of a triangle is a signal characteristic of the second signal, the signal characteristic being proportional to a distance between the media playback device and the one or more playback devices. The instructions for generating a device map indicative of the position in a listening environment of the one or more of playback devices and the media playback device relative to each other based on the first signal and the second signal.

While some examples described herein may refer to functions performed by given actors such as "users" and/or other entities, it should be understood that this is for purposes of explanation only. The claims should not be interpreted to require action by any such example actor unless explicitly required by the language of the claims themselves. It will be understood by one of ordinary skill in the art that this disclosure includes numerous other embodiments.

II. Example Operating Environment

FIG. 1 shows an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102-124, control device 126, 128, and a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
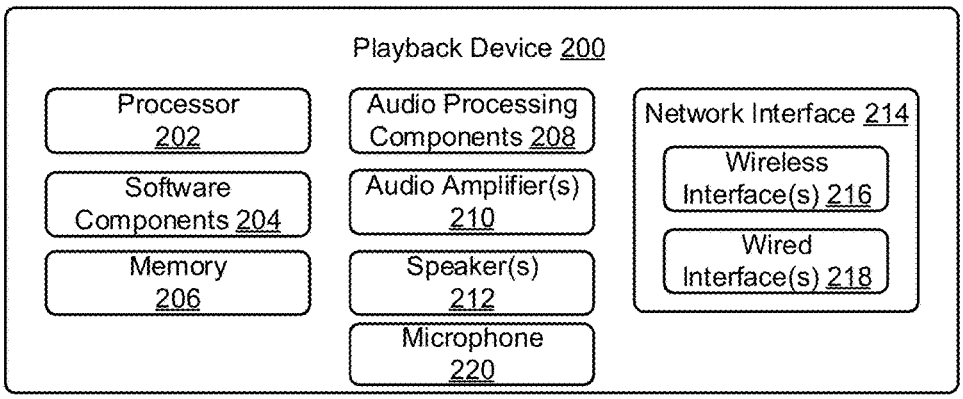
FIG. 2 shows a functional block diagram of an example playback device.

FIG. 2 shows a functional internal block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, and a network interface 214 including wireless interface(s) 216 and wired interface(s) 218. In one case, the playback device 200 may not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. The speaker(s) 212 may also be capable of beam-steering, e.g., playing audio sound in such a way as to aim the audio sound at a particular angle within a window of the playback device. In some instances, independently addressable drivers of the speakers(s) 212 enable beam-steering through physically altering the direction of one or more drivers or offsetting phase for each a given set of audio drivers to aim the sound. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection), or the network interface 214. The playback device may be equipped with a microphone 220 or microphone array 220. The microphone(s) 220 may be an acoustic-to-electric transducer or sensor that converts sound into an electrical signal. The microphone(s) 220 may be used to detect the general location of an audio source. The electrical signal of the microphone(s) 220 may need to be amplified before being further processed. Accordingly, an amplifier such as audio amplifier 210 may also receive the electrical signal from the microphone 220 and amplify it for further processing by the audio processing components 208. The electrical signal may be processed by the audio processing components 208 and/or the processor 202. The microphone(s) 220 may be positioned in one or more orientations at one or more locations on the playback device 200. The microphone(s) 220 may be configured to detect sound within one or more frequency ranges. In one case, one or more of the microphone(s) 220 may be configured to detect sound within a frequency range of audio that the playback device 200 is capable or rendering. In another case, one or more of the microphone(s) 220 may be configured to detect sound within a frequency range audible to humans. Other examples are also possible.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including Bluetooth, WiFi, IEEE 802.11a, 802.11b, 802.11g, 802.11n, 802.11ac, 802.15, 4G mobile communication standard, near field communication (NFC) and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being playing by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
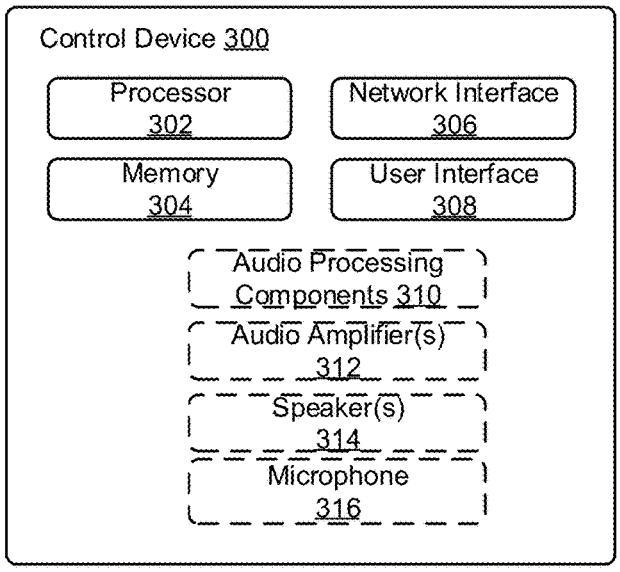
FIG. 3 shows a functional block diagram of an example control device.

FIG. 3 shows a functional block diagram of an example control device 300 that may be configured to be the control device 126 of the media playback system 100. As shown, the control device 300 may include a processor 302, memory 304, a network interface 306, and a user interface 308. In one example, the control device 300 may be a dedicated controller for the media playback system 100. In another example, the control device 300 may be a network device on which media playback system controller application software may be installed, such as for example, an iPhone™, iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be configured to store instructions executable by the processor 302 to perform those functions. The memory 304 may also be configured to store the media playback system controller application software and other data associated with the media playback system 100 and the user.

In one example, the network interface 306 may be based on an industry standard (e.g., infrared, radio, wired standards including IEEE 802.3, wireless standards including Bluetooth, WiFi, IEEE 802.11a, 802.11b, 802.11g, 802.11n, 802.11ac, 802.15, 4G mobile communication standard, near field communications (NFC) and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

In some embodiments, the control device 300 may also be equipped with capability to play back audio sound. According, the control device 300 may have optionally have audio processing components 310, audio amplifier 312, speaker 314 and microphone(s) 316 shown in FIG. 3 as dotted line boxes.

Figure 4:
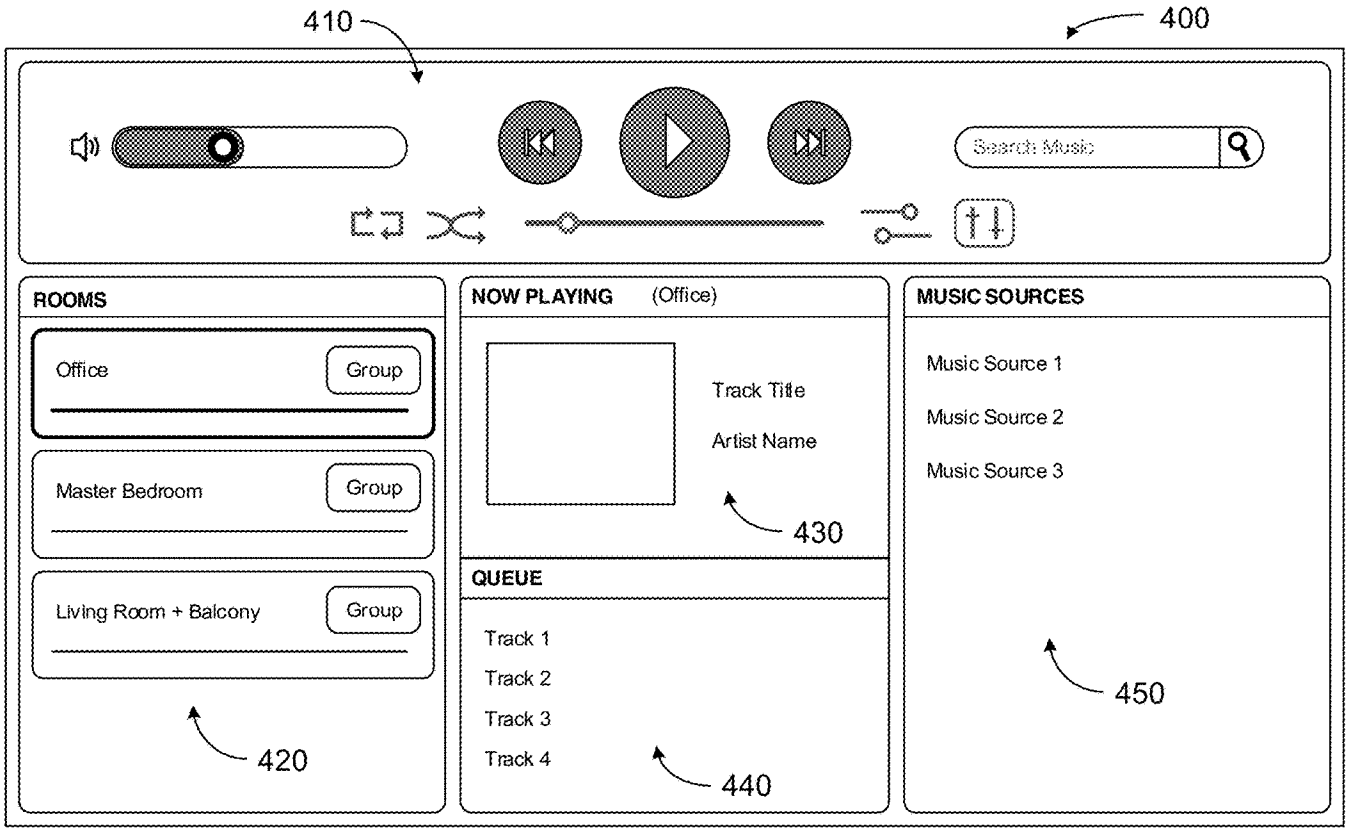
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The user interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the user interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the user interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the user interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g. according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

Figure 5:
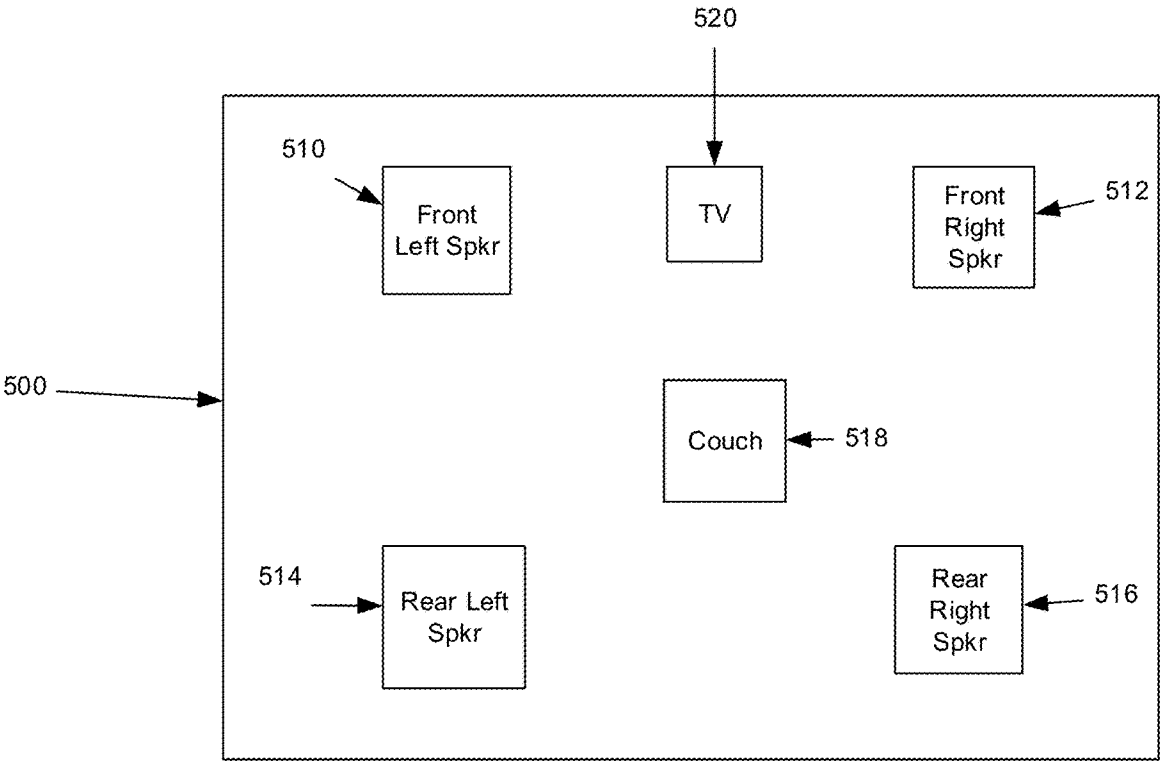
FIG. 5 shows an example listening environment.

III. Example System for Spatial Mapping of Audio Playback Devices in a Listening Environment FIG. 5 shows an example listening environment 500. The example listening environment 500 may be, for example, a home theatre, a bedroom, living room, or even an outdoor space for listening to audio sound. Typically, the listening environment 500 has one or more playback devices such as playback devices 510-516 (identified in FIG. 5 and sometimes referred to herein as speakers for clarity). In the case that the listening environment is a home theater, for example, the playback devices 510-516 may be precisely positioned with respect to a seating area 518 such as a couch so that a listener sitting on the couch can obtain a desired audio experience. Further, the playback devices 510-516 can be precisely positioned with respect to visual media device 520 such as a television to create a desired audio-visual experience.

In embodiments, the listening environment may include the playback devices 510-516 sonically consolidated with one or more other playback devices to form a single, consolidated playback device. Further, the consolidated playback device may further be paired with a single playback device or yet another consolidated playback device. The listening environment may be a listening zone, a playback zone or group such that the playback devices 510-516 may be configured to play audio content in synchrony as individual playback devices, as one or more bonded playback devices, as one or more consolidated playback devices, or any combination thereof. Referring to FIG. 1, the playback zone may be representative of any one of the different rooms and zone groups in the media playback system 100. For instance, the playback zone may be representative of the living room.

The way sound is recorded and played back is also relevant to creating the desired audio experience. Audio sound recorded under such standards such as Dolby 5.1, Dolby 7.1, and Dolby Atmos, defines different channels of audio such as left front channel, right front channel, left rear channel, right rear channel, front center channel and subwoofer channel. Each playback device is to play a particular channel to create the audio experience. For example, audio signals may be delayed, amplified, or attenuated for each of the channels to create the audio experience. In this regard, in the example listening environment, a left front channel may drive playback device 510, a right front channel may drive playback device 512, a rear left channel may drive playback device 514 and a right rear channel may drive playback device 516. Accordingly, the desired audio experience can be achieved within the listening environment 500 with each playback device playing a respective audio channel.

The physical distance and angle of the playback devices relative to each other, such as playback devices 510-516, determine the quality of the audio experience. Playback devices not placed in at the proper distance relative to other playback devices in the listening environment and properly angled will detract from this audio experience.

Figure 6:
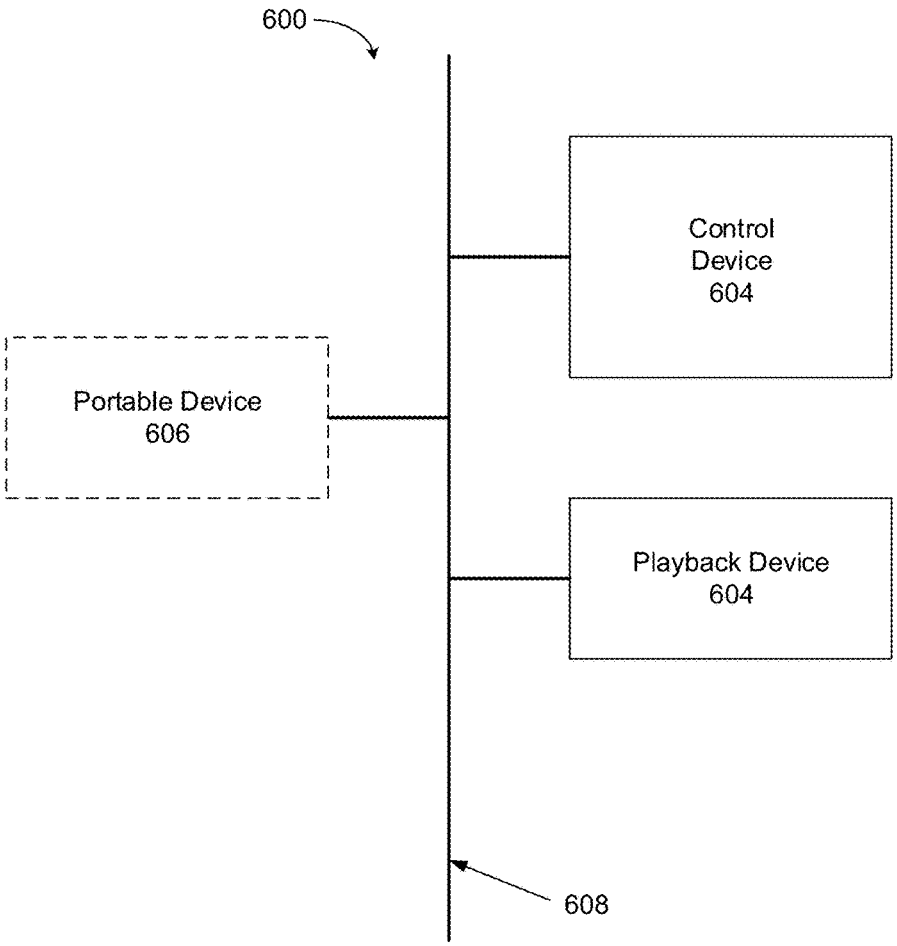
FIG. 6 shows an example system for spatial mapping of audio playback devices in an example listening environment.

FIG. 6 shows an example system for spatial mapping of audio playback devices in a listening environment. The spatial mapping is a process of automatically determining position of each playback device. Specifically, the spatial mapping may involve determining the location and angle of each playback device relative to each other so as to generate a device map such as shown in FIG. 8A.

Referring back to FIG. 6, the system 600 includes one more more playback devices 602, and one or more control devices 604. Each device is communicatively coupled through a communication network 608. The communication network 608 may be a bus, mesh, wired, or wireless network, for example, such that playback devices 600 and control devices 602 may communicate information amongst each other through their respective network interfaces 214, 306. The information may take the form of a device map, spatial position, distance, angle, and/or angular orientation, and/or the data (e.g., signal characteristic) for determining this information. Optionally, the system 600 may also include one or more portable playback devices 606. The portable playback devices 606 may be configured similarly to control device 604 but may perform functions in addition to or instead of controlling the media playback system 100. The portable device 606 may be for example, an iPhone™, iPad™ or any other smart phone, tablet or network device (e.g., a networked computer such as a PC or Mac™).

Figure 7:
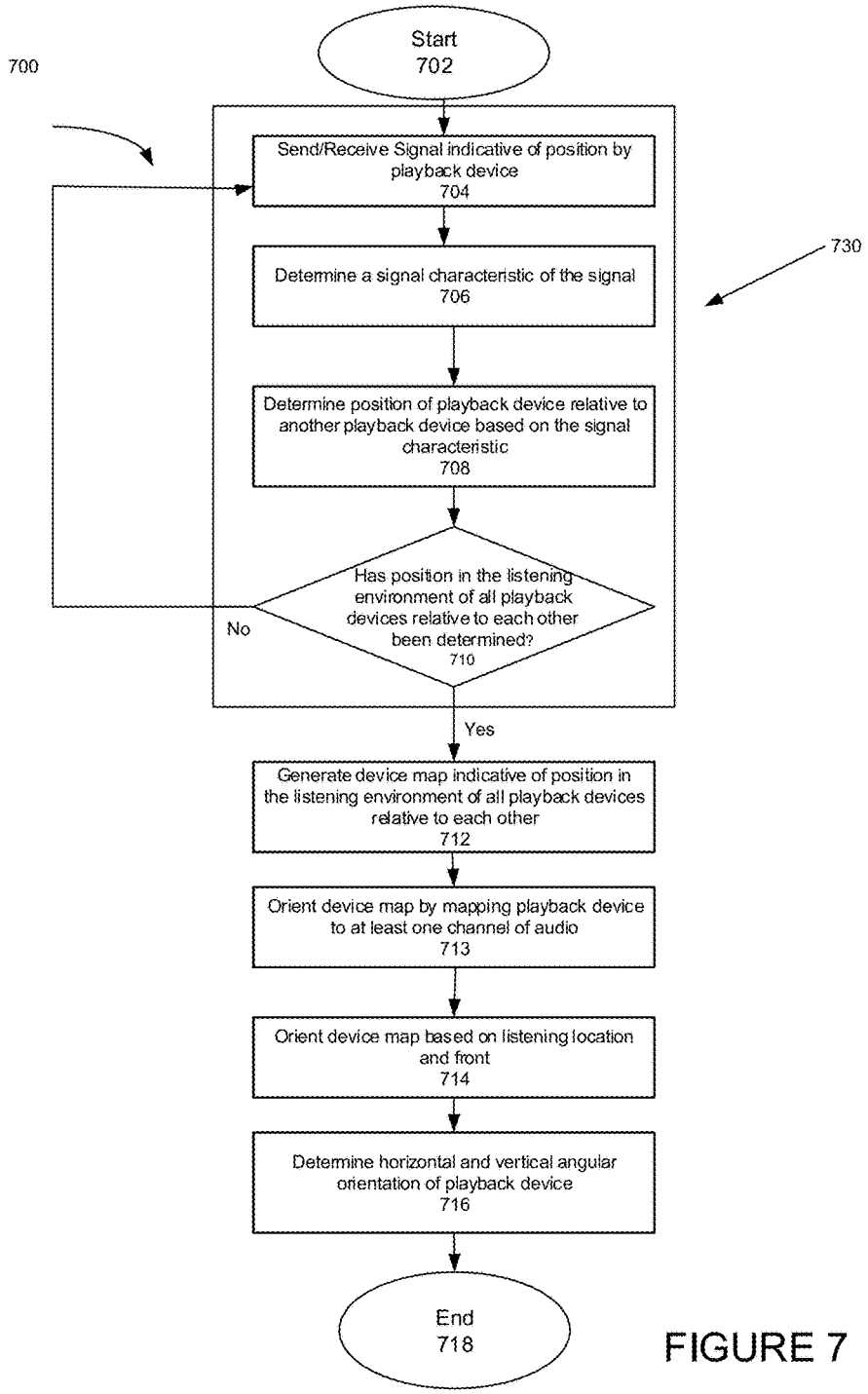
FIG. 7 shows a flowchart representative of an example method or process for spatial mapping of audio playback devices in an example listening environment.

Method 700 shown in FIG. 7 presents an embodiment of a method that can be implemented within an operating environment involving, for example, the media playback system 100 of FIG. 1, one or more of the playback device 200 of FIG. 2, one or more of the control device 300 of FIG. 3, and one or more of the portable device 606 of FIG. 6. Method 700 and the other process disclosed herein may include one or more operations, functions, or actions as illustrated by one or more of blocks such as 702-718 in FIG. 7. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 700 and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 500 and other processes and methods disclosed herein, each block in FIG. 7 may represent circuitry that is wired to perform the specific logical functions in the process.

Referring to FIG. 7, the method 700 for determining a spatial mapping of audio playback devices in a listening environment begins at 702. At 730, one or more playback devices may determine its position relative to the other playback devices.

The positioning process 730 may include operations 704, 706, 708, and 710. As such, at 704, one or more playback devices may send a signal indicative of position to other playback devices and/or one or more playback devices may receive the signal using a sensor such as the network interface 214, 306 or microphone 220, 316. The example signals may take the form of WiFi signals, Bluetooth signals, or audio signals, sent from one playback device to each of the other playback devices in the listening environment. At 706, a signal characteristic of the signal is determined. The signal characteristic may be a signal strength, a delay in receipt of the signal, a loudness, a sound pressure level, and/or a sound intensity, as examples. At 708, a position of the signaling playback device relative to another playback device in the listening environment is determined based on the signal characteristic (e.g., signal). The signal characteristic is indicative of a relative distance between playback devices and by a process of a triangulation using the signal characteristic, for example, the distance and angle of one playback device relative to another can be specifically determined. For example, triangulation will indicate that one device is within a certain distance (e.g., 5 meters) and at a certain angle (e.g., 180 degrees) from another playback device. At 710, a query is made as to whether the position of all or some subset of all of the playback devices in the listening environment relative to each other been determined. If, all or the subset has been determined, then the processing continues to 712; otherwise, the process reverts back to 704. For example, the recited process may continue for each playback device in the listening environment until the position of each playback device relative to the others is known. Each playback device may send a signal to another playback device until all playback devices have sent a signal. And each playback device may receive the signal to determine its relative position with respect to the playback device sending the signal. Each playback device can also communicate this determined position information to the other playback devices over bus 608 so that each playback device has relative position information for all the other playback devices in the listening environment.

The positioning process may take other forms instead of or in addition to the operations recited in 730. For example, the positioning 730 may take the form of an imaging process where the sensor is an imaging sensor such as a video camera or infra-red sensor. In this case, a playback device may not need to signal another playback device and the playback device may process the imaging data using various image processing algorithms to determine the position of the playback devices in the listening environment. Other arrangements are also possible for determining positioning of the playback devices.

At 712, the positioning information of each playback device relative to the other may be represented in the form of a device map. The example device map shows a position, e.g., the distance and angle, in the listening environment of all playback devices relative to each other, or some subset of all of the playback devices. But because the device map may have one or more lines of symmetry, the device map may not be properly oriented. At 713, the device map may be oriented by at least mapping one playback device in the device map to one channel of the audio sound. At 714, the device map may be further oriented based on a listening location in the listening environment and a front of the listening environment. The orientation at 712 and 714 may be a rotation of the device map by a certain degrees or radians in some instances. At 716, the angular orientation of each playback device can also be determined and indicated on the device map. The angular orientation may include the vertical or horizontal angular orientation of each playback device. The method 700 ends at 718.

Figure 8:
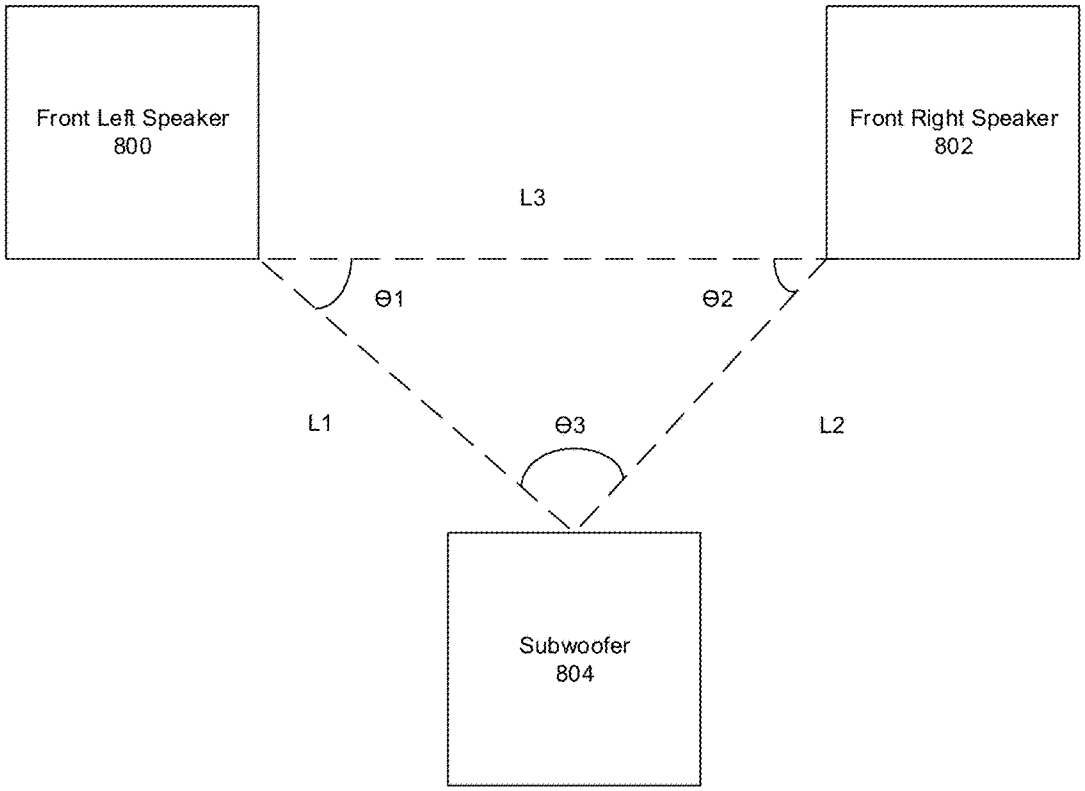
FIG. 8 shows an example illustration of determining relative distance and angle between example playback devices.
Figure 8A:
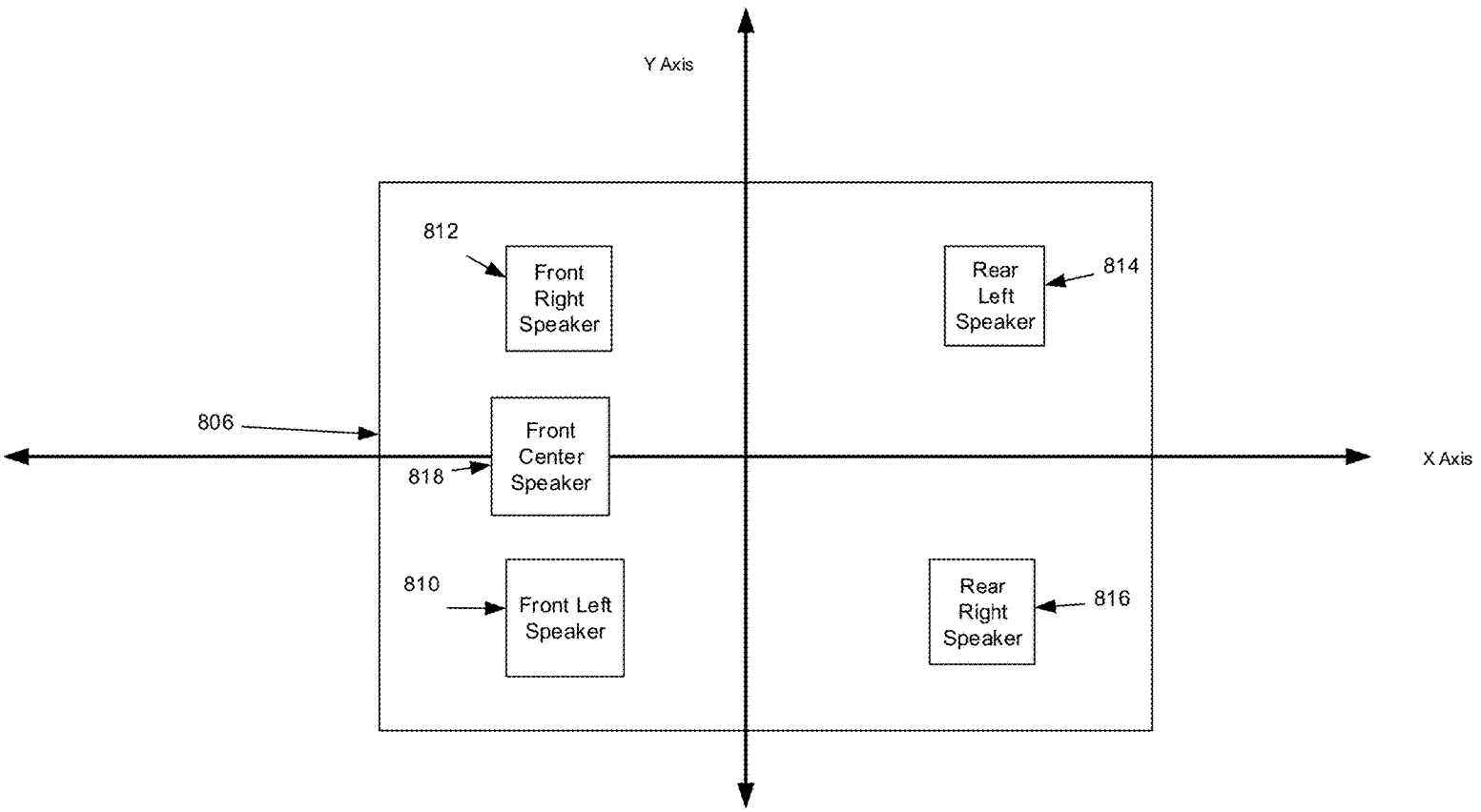
FIG. 8A shows an example device map.

FIG. 8 shows an example graphical illustration of an example process of determining position of each playback device relative to each other as described at 704-710 in FIG. 7. FIG. 8 shows an example of three playback devices, 800-804 arranged in a listening environment. Here, playback device 800 is a front left speaker, playback device 802 is a front right speaker, and playback device 804 is a subwoofer.

As noted above, each playback device may initially signal the other playback devices. For example, playback device 800 may signal playback device 802 and 804 individually, playback device 802 may signal playback device 804 and 800, and playback device 804 may signal playback device 802 and 804. If the playback devices are capable of being individually addressed through some addressing scheme such as MAC addressing, then one or more playback devices may signal one or more other playback devices in parallel.

The signal may take one of many forms. For example, the signal may be a WiFi signal such as WiFi pings supported by the WiFi standard. WiFi pings is a process whereby frames, packets, data, or signals, for instance, are transmitted by a playback device for a certain duration. The WiFi pings may be transmitted to all playback devices in the listening area or as each playback device may be individually addressable, the WiFi pings may be sent to a specific playback device. The data in the WiFi pings may be known or unknown. Alternatively or additionally, the signal may take the form of Bluetooth proximity signal supported by the Bluetooth standard. The Bluetooth proximity signal may be indicative of a proximity of other playback devices in the listening area. Similarly, the Bluetooth proximity signal may be transmitted to all playback devices in the listening area or the Bluetooth proximity signal may be sent to a specific playback device one at a time in the case when the playback device is individually addressable.

Still alternatively or additionally, the signal may take the form of an acoustic signal such as an audio signal. The audio signal may take the form of a test signal, sound, test tone, pulse, rhythm, frequency or frequencies, or audio pattern, for example. For instance, the pulse may be a recording of a brief audio pulse that approximates an audio impulse signal. Some examples include recordings of an electric spark, a starter pistol shot, or the bursting of a balloon. In some examples, the audio signal may include a signal that varies over frequency, such as a logarithmic chirp, a sine sweep, a pink noise signal, or a maximum length sequence. Such signals may be chosen for relatively broader-range coverage of the frequency spectrum or for other reasons. The audio signal may involve other types of audio signals as well.

The audio signal may have a particular waveform. For instance, the waveform may correspond to any of these example audio signals described above, such as, an electric spark, a starter pistol shot, or the bursting of a balloon. Such a waveform may be represented digitally. The playback device may store the first audio signal as a recording. Then, when signaling, the playback device may playback the recording. The recording may take a variety of audio file formats, such as a waveform audio file format (WAV) or an MPEG-2 audio layer III (MP3), among other examples. Alternatively, the playback device may dynamically generate the audio signal. For instance, the playback device may generate a signal that varies over frequency according to a mathematical equation. Other examples are possible as well.

A signal characteristic may be indicative of the proximity or relative distance, $L_1$, $L_2$, $L_3$ between playback devices. Using WiFi pings and Bluetooth proximity signaling, for example, this signal characteristic may be measured in terms of a signal strength such as power, signal level, or error rate of a received signal. The playback device or control device may process the received signal (via processing components such as processor 202, processor 302, audio processing components 208, network interface 214 and network interface 306, for example) to determine the signal characteristic. The signal characteristic may be specifically an RSSI, a measure of the number of packets received by a playback device as compared to the number of packets sent or a characterization of error rate between the transmitted signal and received signal, or some other measure. In this instance, the signal characteristic is proportional to a relative distance between a sending playback device and a receiving playback device.

In the case of audio signaling, the signal characteristic may be determined by way of a playback device playing an audio signal and another playback device "listening" for the audio signal, for example, using the microphone 220. The microphone 220 may be communicatively coupled to the processor 202. For instance, microphone 220 may be coupled to an analog input of processor 202 of playback device 200. Alternatively, microphone 220 may be coupled to an analog-to-digital converter that is coupled, in turn, to processor 202.

In one example, when playback devices are clock synchronized in time, the signal characteristic may be a measure of time delay. The time delay is delay between a playback device sending an audio signal and the time that the audio signal is received by another playback device. This time delay is directly proportional to a distance between the sending and receiving playback device as:

$$d = v_{sound} t_{delay}$$

where: d=distance between devices v_sound=speed of sound in air t_delay=time from audio being played at one device to it being received at another In another example, the signal characteristic may be a loudness of an audio signal played by one playback device and as received by another playback device. The loudness is directly proportional to a distance between the sending and receiving playback device as:

$$d = d_{cal} \cdot 10^{\frac{|L_{cal} - L_{meas}|}{20}}$$

where: d=distance between devices d_cal is the calibration distance at which a device's loudness is known L_cal is the known loudness of the playback device at distance d_cal L_meas is the measured loudness at the receiving device In yet another example, the signal characteristic may be a sound pressure level (SPL) of an audio signal played by one playback device as received by another playback device. The SPL is a measure of actual sound pressure (i.e., magnitude) relative to a reference level. The SPL is directly proportional to a distance between the sending and receiving playback device as:

$$d = \frac{p_{cal} d_{cal}}{p_{meas}}$$

where:

d is the distance between devices p_cal is the Sound Pressure Level at a known calibration distance, d_cal d_cal is the calibration distance at which the sending device's SPL is known p_meas is the SPL measured by the receiving device In another example, the signal characteristic may be a sound intensity of an audio signal played by one playback device as received by another playback device. The sound intensity is a measure of sound power per unit area. The sound intensity is directly proportional to a distance between the sending and receiving playback device as:

$$d = \frac{d_{cal}}{\sqrt{\frac{I_{meas}}{I_{cal}}}}$$

d is the distance between players d_cal is the calibration distance at which the sending device's Sound Intensity is known I_cal is the Sound Intensity at a known calibration distance, d_cal I_meas is the Sound Intensity measured by the receiving device In some examples, the microphone 220 may be positioned behind an acoustic grille of the playback device and receive the audio signal. The acoustic grille may be composed of a variable-acoustic-opacity material. The properties of the material allow higher angles of incidence wave components to pass through the acoustic grille. Additionally, the properties of the material block (or reflect) lower angles of incidence wave components from passing through the acoustic grille. Accordingly, when for example, a playback device receives an audio signal sent by another playback device, the acoustic grille receives the audio signal at varying angles. The acoustic grille filters the audio signal received at relatively lower angles of incidence and the remaining audio signal that pass through the acoustic grille and to the microphones 220 facilitate accurately determining one or more of the signal characteristics described above.

Triangulation is one example for determining the relative distance and angle of the playback devices. Triangulation is a geometrical calculation that involves forming a triangle between two playback devices and a known reference point or three playback devices. Based on knowing the length of two sides of this triangle and an angle, the length of all sides of the triangle, all angles of the triangle, or two angles and a length, the length of all sides of the triangle and the angles of the triangle can be determined through well known mathematical calculations. In the example of FIG. 8, the relative distance determined by the signal characteristic between a sending and receiving playback device indicates a length of a side of the triangle. FIG. 8 has playback devices 800-804 (e.g., speakers). In this example, when playback device 800 sends a signal to playback device 802 and playback device 802 determines the signal characteristic, this signal characteristic is indicative of the distance from playback device 800 to playback device 802, or $L_3$. For instance, when playback device 802 sends a signal to playback device 804 and playback device 804 determines the signal characteristic, this signal characteristic is indicative of the distance from playback device 802 to playback device 804, or $L_2$. For instance, when playback device 800 sends a signal to playback device 804 and playback device 804 determines the signal characteristic, this signal characteristic is indicative of the distance from playback device 800 to playback device 804, or $L_1$. As such, the signal characteristic can translate into knowing the relative distance, $L_1$, $L_2$, $L_3$ between the playback devices and the angles $Ø_1$, $Ø_2$, $Ø_3$ between the playback devices. Other arrangements or combinations are also possible for determining these relative distances and angles.

The triangulation process produces a device map of the spatial mapping of each playback device in the listening area. FIG. 8A shows an example device map 806. The device map 806 may look similar to the listening area of FIG. 5.

The device map may have one or more lines of symmetry. The lines of symmetry indicate symmetric properties of the device map. For instance, the listening area has a line of symmetry with respect to a vertical X axis but not a horizontal Y axis passing through the middle of the listening area. Further, the audio sound played by the audio playback system may include several channels of audio. Each channel of audio may be designed to be played by a particular playback device in the audio playback system. For example, in a two dimensional audio system, a channel of audio may be one of the left front channel, right front channel, center channel, rear left channel, rear right channel or subwoofer. In a three dimensional audio system, there may be also channels above and channels below.

The line of symmetry makes it difficult to know which playback device corresponds to which audio channel in the listening environment. Accordingly, the device map may be oriented by mapping at least one of the playback devices to a channel of the audio sound. For example, by assigning playback device 810 in FIG. 8A to the front left audio channel, the device map is oriented with respect to the X line of symmetry and the remaining channels of the remaining playback devices in the device map are known. As such, playback device 812 is the right front channel, playback device 814 is the rear right channel, playback device 816 is the left right channel, and playback device 818 is the front center channel in this example. The device map in essence in FIG. 8A is oriented (e.g., rotated) by 90 degrees as compared to the device map in FIG. 5.

Figure 9:
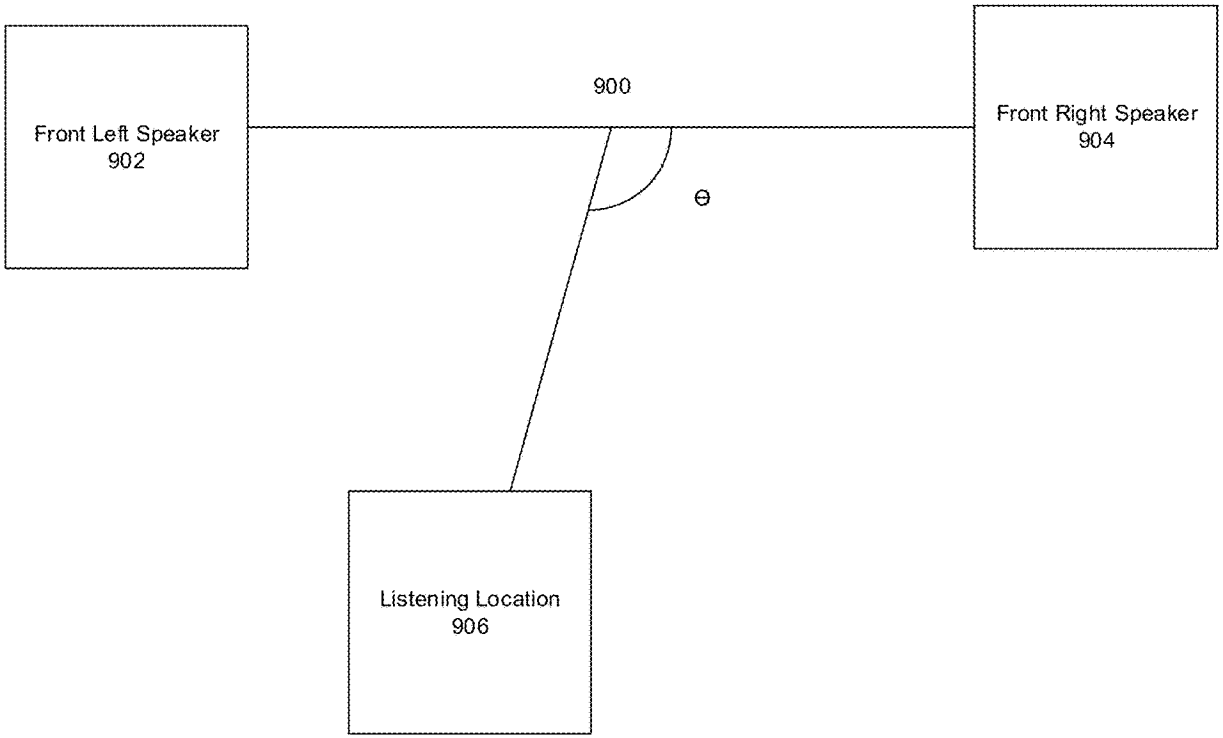
FIG. 9 shows an example illustration of a front and listening location.

FIG. 9 shows that the device map can be further oriented with respect to the listening location and the "front" of the listening area. A listening area may have a front left playback device 902 (e.g., speaker) and a front right playback device 904 (e.g., speaker). The "front" is a virtual point 900 between a front left playback device 902 and a front right playback device 904 in the listening area. Further, the listening location 906 may be situated somewhere in front of the two playback devices 902, 904. The "listening location" may be a couch where the listener sits when listener sits when listening to the audio. In some instances, the listening location 906 may not be optimally equidistant from the left playback device 902 and right playback device 904 and perpendicular to the front 900 between the two playback devices 902, 904. In this case, the device map may be further oriented (e.g., rotated) by an angle Ø, which is the angle between the listening location 906 and the front 900 of the listening area.

There are many ways for determining the location of the "front" and listening location. In one example, the location of the "front" and "listening location" may be input into the control device 300 through a numerical or graphical user interface to determine this orientation angle Ø. In another example, a portable device 606 such the iPhone or iPad can be physically placed at each of the "front" and "listening locations" and through a process of triangulation the "front" and "listening" location can be determined and the device map can be oriented accordingly.

The device map can also account for the angular orientation of each playback device. The angular orientation of the playback device may be composed of two components, a horizontal and vertical component, and indicate how the playback device is angled in a vertical direction or in a horizontal direction.

Figure 10A:
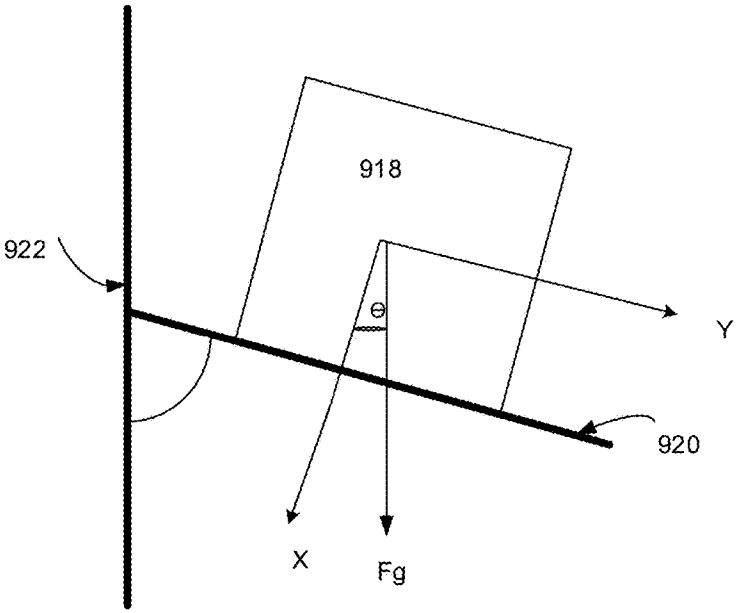
FIG. 10A shows an example vertical angular orientation of an example playback device.

For instance, a playback device may be set on a surface. The surface, however, may not be flat, but instead may be angled vertically either upwards or downwards. FIG. 10A shows an example side profile view of a playback device 918 placed on a surface 920 such as a shelf connected to a wall 922. The shelf may not be horizontal, thus resulting in the playback device not also being positioned horizontally. An angle Ø may indicate an angle between the force of gravity and an X axis, e.g., the vertical component of an angular orientation of the playback device 918. If this angle is substantially zero, then the playback device is positioned horizontally and has no vertical component of an angular orientation. To determine this angle, for example, the playback device 918 may be configured with a multi-axis accelerometer or some other device such as a gyroscope to determine vertical orientation. The multi-axis accelerometer may measure the force of gravity in one or more axes, such as the X axis. For example, knowing the force of gravity $F_g$ and the force of gravity in the X axis, the angle Ø can then be determined through well known trigonometry functions. The angle Ø is indicative of the vertical component of the angular orientation of the playback device on a surface, for example.

Figure 10B:
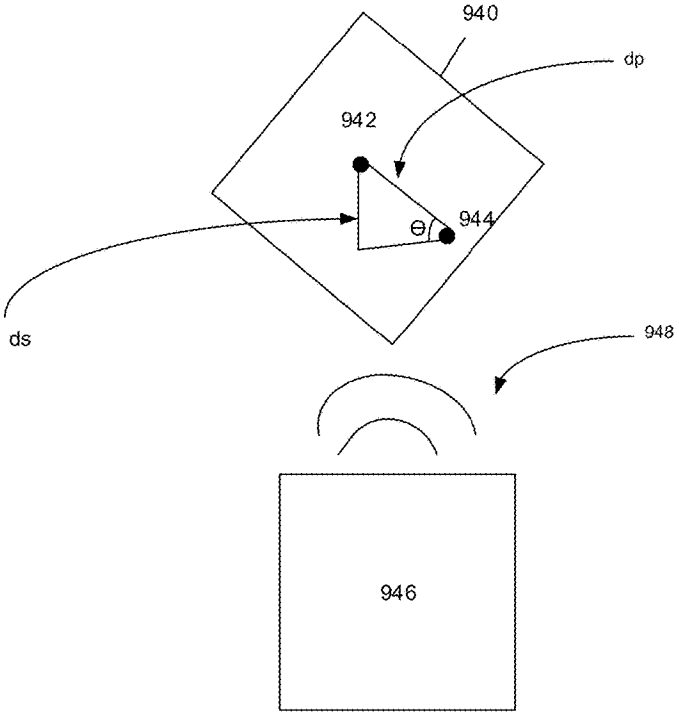
FIG. 10B shows an example horizontal angular orientation of an example playback device.

The playback device may also be angularly oriented horizontally with respect to another playback device. Referring to FIG. 10B, showing a top down view of two example playback devices 940, 946, example playback device 940 may be angularly oriented with respect to playback device 946. In this example, the playback device 940 may be configured with a plurality of microphones such as two microphones, microphone 942 and microphone 944. The microphones may be placed within the playback device 940 in a manner such that the distance between the microphones 942 and 944 is known and linearly separated.

When so equipped, a characteristic of a received audio signal by each microphone can be analyzed to determine an angular orientation of the playback device relative to each other. In the example of FIG. 10B, playback device 946 may send an audio signal 948 to playback device 940. The microphones 942, 944 of playback device 900 may receive the audio signal. There may be a time delay between the time that microphone 942 receives the audio signal 948 and microphone 944 receives the audio signal 948. The time delay, along with a known constant of the speed of sound, can be used to calculate a distance $d_s$ shown in FIG. 10B.

$$d_s=(t_2-t_1)*\text{speed of sound}$$

where $t_2$ is the time microphone 942 receives the audio signal and $t_1$ is the time microphone 944 receives the audio signal Further, the distance $d_p$ between the microphone 942 and microphone 944 is known and fixed. The distances $d_s$ and $d_p$ form two sides of a triangle and by trigonometry, for example, the angle Ø can be determined. The angle Ø is indicative of the horizontal component of an angular orientation of the playback device.

In some examples, the speaker drivers of the playback device may be independently controllable. This means that each driver can generate a specific audio signal independent of the other audio drivers. With independent controllability, the playback device is capable of "beam steering". Beam steering is a process whereby the playback device can send an audio signal in a manner such that it can aim the audio signal at a particular angle and sweep the audio signal across a range of angles. Beam steering may be achieved by physically altering the direction of one or more of the audio drivers, offsetting a phase of the audio signal generated by a plurality of audio drivers such that a desired polar response is achieved. Other methods are also possible.

Figure 10C:
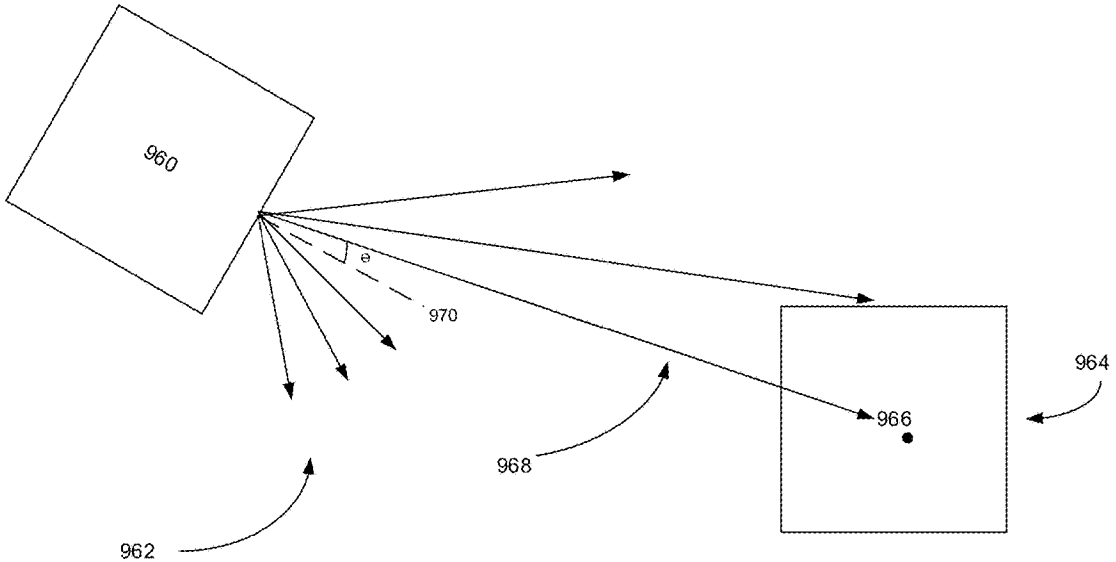
FIG. 10C shows an another example horizontal angular orientation of an example playback device.

FIG. 10C shows an example of this sweeping. A playback device 960 may send a beam steered audio signal 962 to another playback device 964 which can receive the beam-steered audio signal. The playback device 964 may have a microphone 966. With this microphone, the characteristic of the beam steered audio signal 962 may be measured over a course of the sweep. As such, the playback device 960 may communicate a start of the beam sweep to playback device 964 or playback 966 may know the start of the beam sweep. Then the beam is swept. A measured peak 968 of the swept audio signal indicates the beam was directly directed at the playback device 964 receiving the audio signal. Knowing the duration of the beam sweep and the timing of the peak, the horizontal component of the angular orientation can be determined. As an example, the angular orientation may be described in terms of an angle with respect a line perpendicular to a face of the playback device such as 970. In this example, if playback device 960 sweeps from −45 left of center to +45 degrees right of center over 1 second, and a peak is observed at 0.56 seconds, then the angular orientation of the playback device 960 relative to the playback device 964 is therefore 5.4 degrees right of the center.

Figure 11:
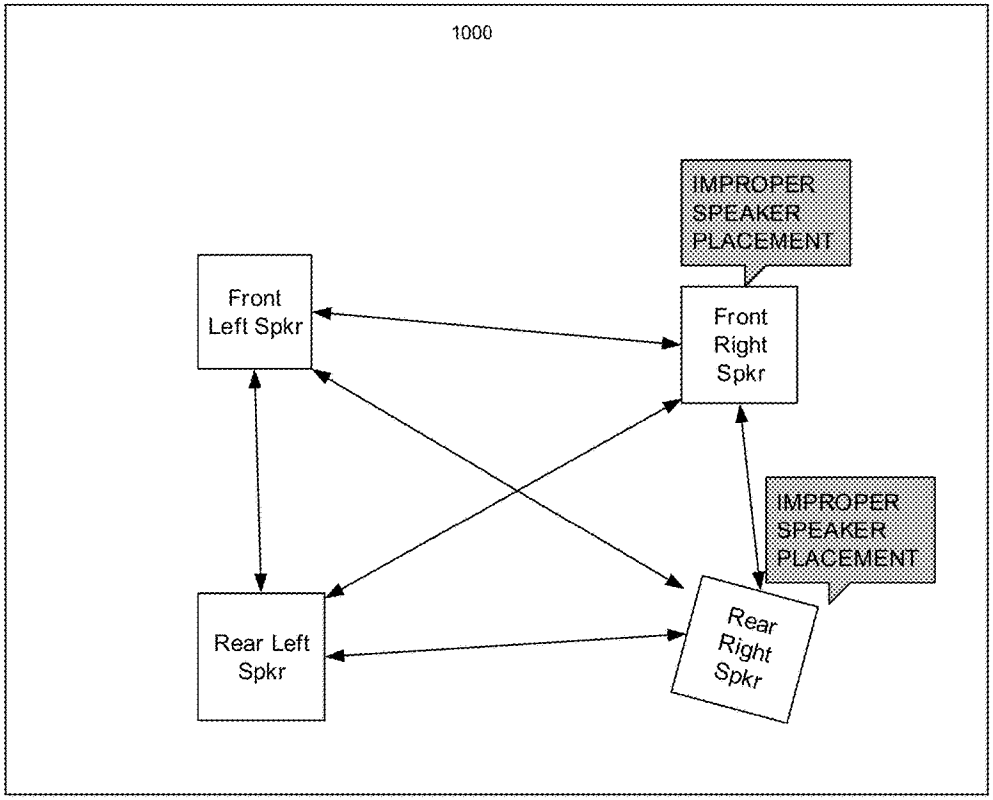
FIG. 11 shows an example of improper speaker placement in an example device map.

In embodiments, the device map may be shown on the user interface 308 of the control device 300. FIG. 11 shows an example controller interface 1000 showing a device map. The controller interface 1000 may show the device map and positioning of the playback devices (e.g., speakers). Specifically, the controller interface 1000 may present a scaled version of the device map based on the positioning, e.g., relative distances, angles, and angular orientations of playback devices in accordance with the device map.

Further, the controller may store in the memory 304 or receive through the network interface 306 ideal positioning of the playback devices in the listening environment. The ideal position may be specified by various audio standards and depend on the number of audio channels in the audio playback system. The controller 300 may compare the device map to the ideal positioning and provide indications of improper playback device placement. The ideal distances, angles, and angular orientations (e.g., parameters) may be defined by an absolute number or an acceptable range. The improper placement may be shown on the controller interface 1000 such as an alert, for example. In this example, the controller device 300 may compare the ideal relative distances, angles, and angular orientations stored in the memory 302 to the actual distances, angles, and angular orientations shown by the device map. If any actual parameters fall outside or exceed the ideal parameters, then the control device 300 may provide some type of indication. The indication may be in the form of alert or a message which indicates improper playback placement. In the example of FIG. 11, the front right speaker may not be aligned with the front left speaker and the right rear speaker may not be angularly orientated in the same direction as the rear left speaker. Further, the indication may specify an action for the user to take to correct the placement, such as moving a playback device in a particular way so that the playback devices are properly positioned.

In some embodiments, the playback device may further have one or more indicators, such as LEDs, display panels, or lights, indicative of operational status of the playback device. A playback device such as the playback device may include the indicators on one or more surfaces of the playback device that provide feedback on the status of the playback device. For example, the indicators may include several different colors of LED lights, for example, such as red, blue, green, and white, which may be mixed to create a broad spectrum of colors. The playback device may also be capable of fading the LED lighting between different colors smoothly and without noticeable flickering. For example, a playback device may have stored in memory one or more LED behavior patterns, each corresponding to a state of the playback device. Some LED behaviors may be a sequence of flashes, featuring one or more colors, to indicate a given state. Other states of the playback device may be indicated by a constant LED light of a given color.

Accordingly, in addition to or instead of the control device 300 providing indication of playback device placement, the playback device may provide similar feedback. For example, the playback device may present the device map on a display. The playback device may also provide an indication of improper positioning of the playback device. For instance, the playback device may output an alert sound when it is improperly placed or provide an indication in the form of an LED or light. For example, the alert sound may be a beep or a sequence of beeps played through the speaker and the LED or light indication may be a flashing or steady light. Other examples are possible to indicate the proper or improper positioning of the playback device as indicated by the device map.

Further, the determination of distance, angle, and angular orientation may be performed by the playback device 200, the control device 300, or a combination of these devices or other devices. In one example, the playback device 200 may receive the audio signal, determine the signal characteristic, and perform position determination for itself. This position information may be then sent to another playback device or control device to determine the device map. In other examples, one or more playback devices may determine the signal characteristic communicate this information to the control device 300 or another playback device such as a "master" zone player in the listening environment processes the information the signal characteristic to determine the position of the playback devices and device map. Other arrangements are also possible.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

We claim:

1. A method comprising:

sending by a given playback device, a first signal indicative of a position of the given playback device wherein the given playback device is associated with a first channel of a plurality of audio channels;

receiving, via a plurality of microphones of the given playback device, a second signal indicative of a respective position of each of one or more other playback devices, wherein each of the one or more other playback devices is associated with a respective channel of the plurality of audio channels;

determining the position of the given playback device relative to each position of the one or more other playback devices based on the second signal indicative of the respective position of each of the one or more other playback devices;

determining an angular orientation of the given playback device relative to each orientation of the one or more other playback devices based on a difference in time delay of receipt of the second signal by the plurality of microphones;

determining an angle between a listening position in the listening environment and a virtual point, wherein the virtual point is a position in the listening environment between the given playback device and one of the one or more other playback devices;

causing a controller device to output, to a display of the controller device, a device map indicating the positions in the listening environment of the given playback device and the one or more other playback devices, wherein the device map is oriented on the display at the determined angle between the listening position and the virtual point;

comparing the determined position and the determined orientation of the given playback device relative to each position and to each orientation of the one or more other playback devices to a corresponding one or more relative reference positions and reference orientations, respectively, wherein the one or more relative reference positions and the one or more relative reference orientations are defined by a predefined audio standard, and wherein a corresponding relative reference position associated with the given playback device and a given device of the one or more other playback devices is based on the first channel associated with the playback device and the respective channel associated with the given device; and based on the comparison, causing a controller device to output an indication in the device map on the display that at least one of the given playback device and the one or other more playback devices is not positioned or oriented in accordance with the one or more relative reference positions or with the one or more reference orientations, respectively, such that repositioning or reorienting in accordance with the one or more relative reference positions and the one or more reference orientations will improve playback of audio by the given playback device and the one or more other playback devices, wherein causing the controller device to output the indication comprises displaying one or more alerts indicating improper placement in the device map, wherein individual alerts of the one or more alerts are positioned in the device map adjacent the at least one of the given playback device and the one or more other playback devices not positioned or oriented in accordance with the one or more relative reference positions or with the one or more reference orientations, respectively.

2. The method of claim 1, wherein the angle is a first angle, wherein determining the position of the given playback device comprises performing a triangulation based on the second signal to determine a distance and a second angle between the given playback device and the one or more other playback devices, and wherein a side of a triangle is a signal characteristic of the second signal, the signal characteristic being proportional to a distance between the given playback device and the one or more other playback devices.

3. The method of claim 1, further comprising generating the device map based on the first signal and the second signal.

4. The method of claim 1, wherein determining the position of the one or other more playback devices relative to the given playback device comprises performing a triangulation based on the second signal to determine a distance and angle between the given playback device and the one or more other playback devices.

5. The method of claim 1, wherein the angular orientation is determined based on a timing of receipt of a peak of a beam-formed signal by a microphone of the given playback device.

6. The method of claim 1, wherein determining the angular orientation comprises determining a horizontal angular orientation of the device and a vertical angular orientation of the given playback device.

7. A tangible non-transitory computer readable storage medium including a set of instructions that when executed by a processor cause a media playback system to:

sending by a media playback device, a first signal indicative of a position of the media playback device wherein the given playback device is associated with a first channel of a plurality of audio channels;

receiving, via a plurality of microphones of the given playback device, a second signal indicative of a respective position of each of one or more other playback devices, wherein each of the one or more other playback devices is associated with a respective channel of the plurality of audio channels;

determining the position of the media playback device relative to each position of the one or more other playback devices based on the second signal indicative of the respective position of each of the one or more other playback devices;

determining an angular orientation of the media playback device relative to each orientation of the one or more other playback devices based on a difference in time delay of receipt of the second signal by the plurality of microphones;

determining an angle between a listening position in the listening environment and a virtual point, wherein the virtual point is a position in the listening environment between the media playback device and one of the one or more other playback devices;

causing a controller device to output, to a display of the controller device, a device map indicating the positions in the listening environment of the one or more other playback devices and the media playback device, wherein the device map is oriented on the display at the determined angle between the listening position and the virtual point;

comparing the determined position and the determined orientation of the media playback device relative to each position and to each orientation of the one or more other playback devices to a corresponding one or more relative reference positions and reference orientations, respectively, wherein the one or more relative reference positions and the one or more relative reference orientations are defined by a predefined audio standard, and wherein a corresponding relative reference position associated with the media playback device and a given device of the one or more other playback devices is based on the first channel associated with the playback device and the respective channel associated with the given device; and based on the comparison, causing a controller device to output an indication in the device map on the display that at least one of the media playback device and the one or other more playback devices is not positioned or oriented in accordance with the one or more relative reference positions or with the one or more reference orientations, respectively, such that repositioning or reorienting in accordance with the one or more relative reference positions and the one or more reference orientations will improve playback of audio by the media playback device and the one or more other playback devices, wherein causing the controller device to output the indication comprises displaying one or more alerts indicating improper placement in the device map, wherein individual alerts of the one or more alerts are positioned in the device map adjacent the at least one of the media playback device and the one or more other playback devices not positioned or oriented in accordance with the one or more relative reference positions or with the one or more reference orientations, respectively.

8. The tangible non-transitory computer readable storage medium of claim 7, wherein the angle is a first angle, wherein the instructions for determining the position comprises performing a triangulation based on the second signal to determine a distance and a second angle between the media playback device and each of the one or more playback other devices, wherein a side of a triangle is a signal characteristic of the second signal, the signal characteristic being proportional to a distance between the media playback device and the one or more other playback devices.

9. The tangible non-transitory computer readable storage medium of claim 7, further comprising instructions for generating the device map based on the first signal and the second signal.

10. The method of claim 1, wherein the angle between the listening position and the virtual point is an oblique angle.

11. The tangible non-transitory computer readable storage medium of claim 7, wherein the angle between the listening position and the virtual point is an oblique angle.

12. A media playback system, comprising:

a first playback device;

one or more other playback devices; and tangible non-transitory computer readable media storing instructions, that when executed by one or more processors, cause the media playback system to:

sending, by the first playback device, a first signal indicative of a position of the first playback device wherein the given playback device is associated with a first channel of a plurality of audio channels;

receiving, via a plurality of microphones of the given playback device, a second signal indicative of a respective position of each of one or more other playback devices, wherein each of the one or more other playback devices is associated with a respective channel of the plurality of audio channels;

determining the position of the first playback device relative to each position of the one or more other playback devices based on the second signal indicative of the respective position of each of the one or more other playback devices;

determining an angular orientation of the first playback device relative to each orientation of the one or more other playback devices based on a difference in time delay of receipt of the second signal by the plurality of microphones;

determining an angle between a listening position in the listening environment and a virtual point, wherein the virtual point is a position in the listening environment between the first playback device and one of the one or more other playback devices;

causing a controller device to output, to a display of the controller device, a device map indicating the positions in the listening environment of the one or more other playback devices and the first playback device, wherein the device map is oriented on the display at the determined angle between the listening position and the virtual point;

comparing the determined position and the determined orientation of the first playback device relative to each position and to each orientation of the one or more other playback devices to a corresponding one or more relative reference positions and reference orientations, respectively, wherein the one or more relative reference positions and the one or more relative reference orientations are defined by a predefined audio standard, and wherein a corresponding relative reference position associated with the first playback device and a given device of the one or more other playback devices is based on the first channel associated with the playback device and the respective channel associated with the given device; and based on the comparison, causing a controller device to output an indication in the device map on the display that at least one of the first playback device and the one or other more playback devices is not positioned or oriented in accordance with the one or more relative reference positions or with the one or more reference orientations, respectively, such that repositioning or reorienting in accordance with the one or more relative reference positions and the one or more reference orientations will improve playback of audio by the first playback device and the one or more other playback devices, wherein causing the controller device to output the indication comprises displaying one or more alerts indicating improper placement in the device map, wherein individual alerts of the one or more alerts are positioned in the device map adjacent the at least one of the first playback device and the one or more other playback devices not positioned or oriented in accordance with the one or more relative reference positions or with the one or more reference orientations, respectively.

* * * * *